United States Patent [19]

Quang

[11] 3,943,418

[45] Mar. 9, 1976

[54] CORONA CHARGING DEVICE

[75] Inventor: Pham Kim Quang, Dieppe, France

[73] Assignee: La Cellophane, Paris, France

[22] Filed: Feb. 18, 1975

[21] Appl. No.: 550,726

[30] Foreign Application Priority Data

Mar. 8, 1974 France ..... 74.07905

[52] U.S. Cl. ..... 317/262 A; 55/147; 250/324; 313/278

[51] Int. Cl.[2] ..... H01T 19/00

[58] Field of Search ..... 317/4, 262 A; 250/324–326; 55/140, 147; 313/278

[56] References Cited

UNITED STATES PATENTS

| | | | |
|---|---|---|---|
| 3,277,298 | 10/1966 | Tiger et al. | 250/326 |
| 3,770,972 | 11/1973 | Hastwell | 250/324 |
| 3,790,999 | 2/1974 | Gallo, Jr. | 250/326 X |
| 3,840,744 | 10/1974 | Hedman, Jr. | 250/324 |

*Primary Examiner*—R. N. Envall, Jr.
*Assistant Examiner*—Harry E. Moose, Jr.
*Attorney, Agent, or Firm*—Sherman & Shalloway

[57] ABSTRACT

A corona charging device includes a U-shaped corona wire which is mounted between a pair of insulating blocks. One of the blocks has a spring biased plunger which engages the closed end of the wire to thereby place the wire in tension while the other block supports the legs of the wire. The legs of the wire have contact portions thereon which extend into a slot in the associated block. The contact portions are held in engagement with an electrical connector by a wedge. With this arrangement, the corona charging wire is readily replaceable.

11 Claims, 6 Drawing Figures

CORONA CHARGING DEVICE

BACKGROUND OF THE INVENTION

1. Field of the Invention

The present invention relates to corona charging devices and, more particularly, corona charging devices that are used in electrophotographic reproduction apparatus to give the photoconductive surfaces an electrostatic charge prior to light exposure.

2. Technical Considerations and Prior Art

Generally, corona charging devices use a U-shaped wire which is preferably placed between two supports of insulating material which are inserted in the two ends of a metal screen which forms a grounded gutter. The wires have free ends which must always be perfectly taut and are connected to a high voltage source of electricity which causes the corona effect by giving rise to a current that generates a charge.

Like all fine wires subjected to a high voltage current, the wires of this device must be changed frequently because they attract dust from the air charged with tribo-electricity. This dust accumulates on the wires, modifying the properties thereof which produced local over-voltages thereon rapidly, causing charge defects. The wires, therefore, require replacement.

Replacement of these wires is a delicate and complicated operation because the wires have to be strung correctly while avoiding excess tautness which might break the wires. After they are strung, they must then be connected to the high voltage source. It is, of course, desirable to replace these wires rapidly to minimize the downtime of the apparatus using the wires. This change, therefore, requires the intervention of an experienced person, if not of a specialist.

To obtain the correct tension of the wire, the wire is wound in several turns around the smooth part of the shank of a screw which is fastened in the input support. Then the wire is strung along a path which connects it to the opposite support and is brought back to the input support where it is fastened in the same way by winding around another screw.

The wire tension is regulated by modifying the winding of the wire around these two screws. This is accomplished by screwing the screws in or backing them off. Considerable experience is required to regulate these screws suitable without breaking the wire, and the prior art approach is not immune from relaxation of friction that loosens the wire, which can cause disturbances of the charge and damage to the device. Generally, an effort is made to compensate for this relaxation by using a spring that extends from one of the ends of the wire.

OBJECTS OF THE INVENTION

In view of the afore-mentioned deficiencies in prior art corona discharge wires, it is an object of this invention to provide a new and improved corona charging device.

It is another object of the instant invention to provide a new and improved corona charging device in which a corona charging wire used therein is conveniently replaceable.

It is still another object of the instant invention to provide a new and improved corona charging device which is uncomplicated in structure.

It is a further object of the instant invention to provide a new and improved corona discharge wire which may be replaced by one who is not necessarily skilled in such an operation.

It is an additional object of the instant invention to provide a new and improved corona discharge wire which is readily adjustable after its installation.

SUMMARY OF THE INVENTION

The present invention contemplates a U-shaped corona discharge wire which has a median part that goes around a spring tensioner placed in one of the ends. This tensioner provides the wire with suitable tension. The free ends of the wire fit into a slot at the other end where they come into contact with the surface of a metal rod. The contact is assured by a key inserted by force into the slot. One of the metal rods is connected to a high voltage source of the corona charging device.

The key may be of trapezoidal shape with opposite faces which are almost parallel. The key assures positive fastening of the end of the wire with minimum time while the appropriate tension is imparted by the spring bias tensioner. Excellent electrical contact is established with the metal rod which is also secured through action of the key.

Preferably, the rod is sunk in the corresponding insulating end and oriented perpendicular to the path of the electric wires, in a housing provided for this purpose. The rod is also preferably cylindrical and includes two shoulders which prevent lateral sliding of the wires when they are inserted. Beyond one of the shoulders, an extension is provided over which a standard commercial female connector is fitted to connect to a high voltage source.

The invention will be better understood from the accompanying drawings which illustrate an embodiment of the invention and which are not to be construed as limiting.

DESCRIPTION OF THE PREFERRED EMBODIMENT

Figure 1:
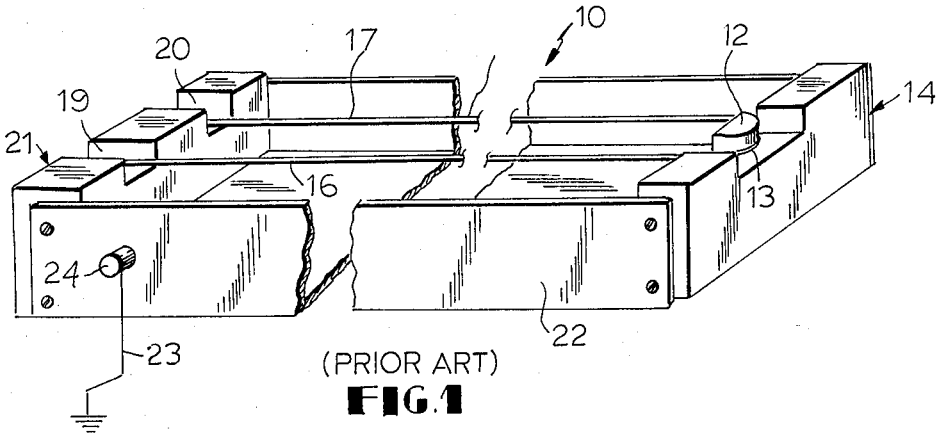
(PRIOR ART) FIG. 1
FIG. 1 is a perspective view schematically illustrating a prior art type corona charge device of the type of which the instant invention is an improvement.

Referring now to FIG. 1, there is schematically shown a corona charging device, designated generally by the numeral 10, which is illustrative of the apparatus of the prior art. In this device, a corona charging wire 11 is bent into a U-shape and fitted around a projection 12 at its closed end 13. The projection 12 extends from an insulating block 14 which is made of a material such as nylon. The corona charging wire 11 has two legs 16 and 17 which have their free ends contained in slots 19 and 20, respectively, which are formed in a second insulating block 21. The blocks 14 and 21 are contained in a metal channel 22 which is grounded by a wire 23 wrapped around a pin 24 extending from the channel. This prior art embodiment is subject to all of the deficiencies set forth in the discussion of the prior art above.

Figure 2:
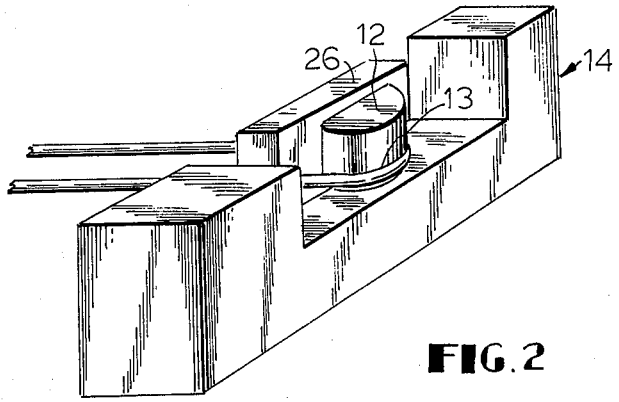
FIG. 2 is a perspective view of one end of the device of FIG. 1 showing how a corona charging wire is mounted.
Figure 4:
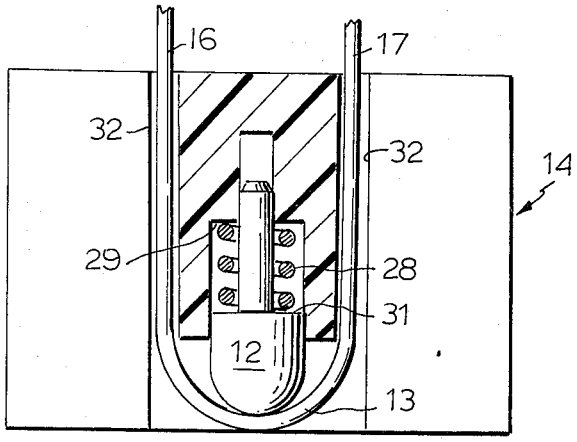
FIG. 4 is a top planar view showing a spring tensioning device according to the instant invention placed in the end illustrated in FIG. 2.

Referring now to FIGS. 2 and 4, an embodiment of the instant invention is shown where the projection 12 is no longer integral with the block 14. Rather, as seen in FIG. 4, the projection 12 is slidably mounted in a retainer 26 which projects from the block 14. The projection 12 is biased outwardly by a spring 28 having one end which abuts a shoulder 29 in the retainer and an inside end 31 of the projection. The two legs 16 and 17 extend past the retainer 26 through a pair of slots 32 in block 14.

Figure 3:
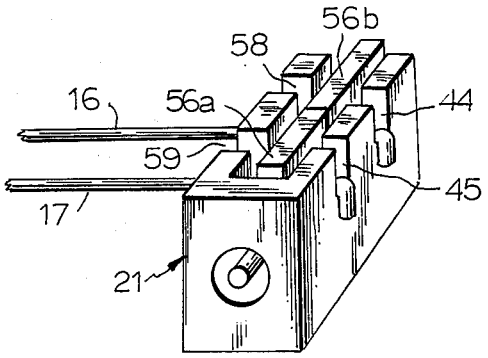
FIG. 3 is a perspective view of the opposite end of the device of FIG. 1 showing how the other end of the corona charging wire is mounted.
Figure 5:
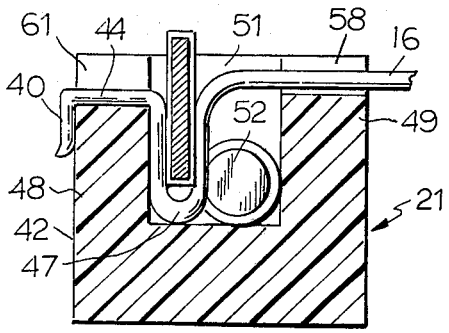
FIG. 5 is a section through the end illustrated in FIG. 3 showing how the end of a corona charging wire is secured in place.
Figure 6:
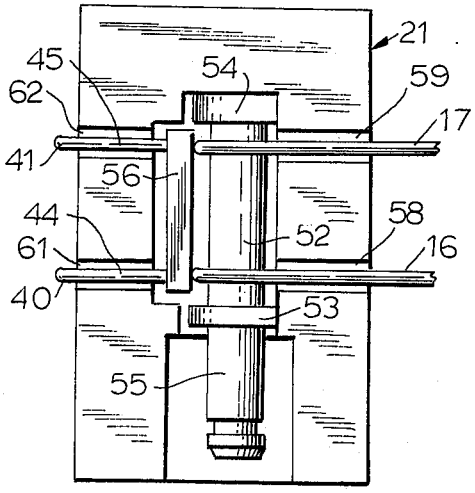
FIG. 6 is a top view of the arrangement shown in FIG. 5.

Referring now to FIGS. 3, 5 and 6, there is shown an embodiment illustrating how the legs 16 and 17 of the corona charging wire 11 are secured to the insulating block 21 in accordance with the principles of the instant invention. As seen in FIGS. 3 and 5, the legs 16 and 17 have bent portions 40 and 41 which fit over the exterior surface 42 of the insulating block 21. As seen specifically in FIG. 5, the bent portion 40 projects from a straight portion 44 which is parallel to the leg 16. The bent portion 41 projects from a similar parallel portion 45 which is shown in FIG. 6. The parallel portions 44 and 45 are joined to the legs 16 and 17 by U-shaped portions 47 which cooperate with bent portion 40 to fit around a shoulder or lip 48 projecting up from the block 21.

The shoulder or lip 48 cooperates with another shoulder 49 also projecting from the block 21 to form a cavity 51 into which the U-shaped portion 47 fits. An electrical connector in the form of a rod 52 is received in the cavity 51 and has a pair of shoulders 53 and 54 therearound which serve to laterally hold the corona charging wire 11 in place. In addition, the connector 52 includes a plug portion 55 extending therefrom onto which a female connector (not shown) is mounted to connect the connector to a high voltage source (not shown). The corona charging wire 11 is held in firm engagement with the connector 52 by a wedge or key 56 inserted in the U-shaped portions 47 of the corona charing wire. The key 56 preferably has a trapezoidal shape wherein the opposite sides which engage the U-shaped portion are not quite parallel.

In order to avoid contact between the corona charging wire 11 and other apparatus, the insulating block 21 has grooves 58 and 59 which receive the legs 16 and 17, respectively, and grooves 61 and 62 which receive parallel portions 44 and 45, respectively.

As shown in FIG. 3, the key 56 can be divided into two portions **56*a* and 56*b* to create an arrangement for conveniently adjusting tension on the wire 11. This is accomplished by adjusting the insertion depth of one of the keys 56*a* or 56*b* after the other key has been inserted to hold one of the legs 16 or 17** in position.

The afore-described key arrangement, either with a single key 56 or with a pair of keys **56*a* and 56*b*, cooperates with the spring bias projection 12 to apply the proper tension to the corona charging wire 11**.

The above description is merely illustrative of an embodiment of the instant invention which is to be limited only by way of the following appended claims.

I claim:

1. A corona charging device comprising:

a corona charging wire which is substantially U-shaped in configuration with a closed end portion and first and second legs extending therefrom;

a first insulator for supporting the closed end portion of the corona charging wire, said insulator having a projection extending therefrom which is biased against the end portion in a direction opposite the extent of said legs;

a second insulator spaced from said first insulator for supporting the legs of said corona charging wire adjacent the free ends of said legs;

a slot extending in said second insulator for receiving contact portions of said legs;

an electrical contact in said slot for engagement by said contact portions; and means for urging said contact portions into engagement with said electrical contact.

2. The device of claim 1, wherein the contact portions of said legs are U-shaped in configuration and wherein said urging means is a wedge which is received in said U-shaped portion to spread said U-shaped portion into engagement with the electrical contact and a wall of said slot.

3. The apparatus of claim 2, wherein the slot extends transverse to the extent of said legs and wherein the electrical contact extends parallel to the extent of said slot.

4. The apparatus of claim 3, wherein each leg further includes a portion extending from U-shaped portion which hooks over a shoulder defined by the slot and an exterior surface of said second insulator.

5. The apparatus of claim 4, wherein the second insulator includes a pair of slots therein which extend perpendicular to said slot and which receive said first and second legs, and wherein said first insulator includes slots therein which receive said first and second legs adjacent said closed end portion.

6. The apparatus of claim 1, wherein the second insulator includes a pair of slots therein which extend perpendicular to said slot and which receive said first and second legs, and wherein said first insulator includes slots therein which receive said first and second legs adjacent said closed end portion.

7. The device of claim 1, wherein said projection which engages said closed end of said corona charging device is seated in a retainer extending from said insulator and wherein means for biasing said projection is seated between said retainer and said projection.

8. The device of claim 7, wherein said projection is a plunger.

9. The device of claim 2, wherein said wedge means is divided into two sections, one of which engages the contact portion of one leg and the other of which engages the contact portion of the other leg to facilitate tensioning of said corona charging wire.

10. The device of claim 1, wherein the first and second insulators are joined by a metal channel which is grounded and wherein the electrical contact is adapted for connection to a high voltage source.

11. The apparatus of claim 1, wherein the electrical contact is a rod having a pair of shoulders thereon outboard of said legs to assist in holding said legs and said electrical contact in said first insulator.

* * * * *